US010988846B2

(12) United States Patent
Shannon et al.

(10) Patent No.: US 10,988,846 B2
(45) **Date of Patent: *Apr. 27, 2021**

(54) ELECTRODE ASSEMBLY, ELECTRODE STRUCTURES AND ELECTROLYSERS

(71) Applicant: INEOS TECHNOLOGIES SA, Vaud (CH)

(72) Inventors: Gary Martin Shannon, Macclesfield (GB); Brian Kenneth Revill, Sarzeau (FR)

(73) Assignee: INEOS TECHNOLOGIES SA, Vaud (CH)

( * ) Notice: Subject to any disclaimer, the term of this patent is extended or adjusted under 35 U.S.C. 154(b) by 407 days.

This patent is subject to a terminal disclaimer.

(21) Appl. No.: 15/567,644

(22) PCT Filed: Apr. 12, 2016

(86) PCT No.: PCT/EP2016/058021

§ 371 (c)(1),
(2) Date: Oct. 19, 2017

(87) PCT Pub. No.: WO2016/169813

PCT Pub. Date: Oct. 27, 2016

(65) Prior Publication Data

US 2018/0148848 A1 May 31, 2018

(30) Foreign Application Priority Data

Apr. 20, 2015 (EP) ..... 15164303
Apr. 20, 2015 (EP) ..... 15164309

(51) Int. Cl.
*C25B 9/00* (2021.01)
*C25B 9/18* (2006.01)
(Continued)

(52) U.S. Cl.
CPC ..... *C25B 1/24* (2013.01); *C25B 9/19* (2021.01); *C25B 9/77* (2021.01); *C25B 15/08* (2013.01)

(58) Field of Classification Search
CPC ..... C25D 17/10; C25D 17/12; C25D 17/004; C25D 21/12; C25D 17/02; C25B 9/18; C25B 9/00; C25B 9/12
See application file for complete search history.

(56) References Cited

U.S. PATENT DOCUMENTS 3,463,722 A 8/1969 Westerlund
3,732,153 A 5/1973 Harke et al.
(Continued)

FOREIGN PATENT DOCUMENTS

CA 892 733 A 2/1972
CN 101550552 10/2009
(Continued)

OTHER PUBLICATIONS

Presentation by UhdeNora; "Development update of UHDENORA technologies", CloroSur—2012 (31 pgs.).
(Continued)

*Primary Examiner* — Zulmariam Mendez
(74) *Attorney, Agent, or Firm* — Nixon & Vanderhye P.C.

(57) ABSTRACT

The present invention relates to an electrode assembly, electrode structures and an electrolyser using said assemblies/structures, and in particular provides an electrode assembly comprising an anode structure and a cathode structure, each of said anode structure and cathode structure comprising i) a flange which can interact with a flange on an another electrode structure to hold a separator in between the two, ii) an electrolysis compartment which contains an electrode, and which in use contains a liquid to be electrolysed, iii) an inlet for the liquid to be electrolysed and iv) an outlet header for evolved gas and spent liquid, wherein the outlet header on one of the anode structure and the cathode structure is an external outlet header and the outlet header on the other one of the anode structure and the cathode structure is an internal outlet header, as well as to electrolysers comprising a plurality of such electrode assemblies.

17 Claims, 6 Drawing Sheets

(51) Int. Cl.

| | |
|---|---|
| ***C25B 1/24*** | (2021.01) |
| ***C25B 15/08*** | (2006.01) |
| ***C25B 9/19*** | (2021.01) |
| ***C25B 9/77*** | (2021.01) |

(56) References Cited

U.S. PATENT DOCUMENTS

| | | | | |
|---|---|---|---|---|
| 4,505,789 | A | 3/1985 | Ford | |
| 5,314,591 | A | 5/1994 | Katayama et al. | |
| 6,761,808 | B1 | 7/2004 | Revill et al. | |
| 7,363,110 | B2 * | 4/2008 | Revill | C25B 9/08 700/245 |
| 2004/0118677 | A1 | 6/2004 | Streckert et al. | |
| 2006/0108215 | A1 | 5/2006 | Tzedakis et al. | |

FOREIGN PATENT DOCUMENTS

| | | | |
|---|---|---|---|
| EP | 0 521 386 | A2 | 1/1993 |
| EP | 0 521 386 | A3 | 1/1993 |
| EP | 0 704 556 | A1 | 4/1996 |
| GB | 1 581 348 | | 12/1980 |
| GB | 1 595 183 | | 8/1981 |
| GB | 1 595183 | A | 8/1981 |

OTHER PUBLICATIONS

Presentation by"INEOS Technologies Integrated Service", CLORO SUR—2012 (36 pgs.).

* cited by examiner

ELECTRODE ASSEMBLY, ELECTRODE STRUCTURES AND ELECTROLYSERS

This application is the U.S. national phase of International Application No. PCT/EP2016/058021 filed Apr. 12, 2016 which designated the U.S. and claims priority to European Patent Application Nos. 15164303.8, filed Apr. 20, 2015 and 15164309.5, filed Apr. 20, 2015, the entire contents of each of which are hereby incorporated by reference.

The present invention relates to an electrode assembly, electrode structures and an electrolyser using said assemblies/structures, in particular but not exclusively for use in the electrolysis of alkali metal chlorides.

Bipolar electrolysers are known in the art, for example as described in GB 1581348 or U.S. Pat. No. 6,761,808.

Bipolar electrolysers for use in the electrolysis of aqueous solutions of alkali metal chloride may comprise an electrode module comprising an anode which is suitably in the form of a plate or mesh of a film-forming metal, usually titanium carrying an electrocatalytically active coating, for example a platinum group metal oxide, and a cathode which is suitably in the form of a perforated plate of metal or mesh, usually nickel or mild steel. The anode and cathode are separated by a separator, typically a membrane, to form a module.

In a commercial modular electrolyser a multiplicity of such modules are placed in sequence with the anode of one bipolar module next to and electrically connected to the cathode of an adjacent bipolar module.

In operating an electrolyser of the bipolar type it is advantageous to operate with as small a distance as possible between the anode and cathode (the anode/cathode gap) in order to keep ohmic losses, and hence the cell voltage to a minimum.

Another type of bipolar electrolyser is a so-called "filter press electrolyser", for example as described in GB 1595183. In these electrolysers bipolar electrode units are formed comprising an anode structure and a cathode structure which are electrically connected to each other. The bipolar electrode units are then connected to adjacent bipolar electrode units via a separator and sealing means between flanges on the adjacent units, and the units compressed together to form a filter press electrolyser.

U.S. Pat. No. 6,761,808 describes an electrode structure comprising a pan with a dished recess and a flange for supporting a gasket capable of sealing a separator between the surface of an anode and a cathode. The dished recess has projections which mate with projections on an adjacent electrode structure. These electrode structures may be assembled into electrolyser modules or bipolar electrode units, and then further combined to form modular electrolysers or filter press electrolysers.

The anode and cathode structures in a bipolar electrolyser comprise independent inlets for liquid to be electrolysed and outlets for evolved gases. As shown in U.S. Pat. No. 6,761,808 the outlets can be provided as outlet headers in a non-electrolysis area above the electrolysis compartment in the electrode structure. Because they are provided outside of the electrolysis compartment in the electrode structure such outlets may be referred to as "external outlet headers".

CA892733 relates to an electrolysis apparatus. In this document there is described the presence of internal headers for both the anolyte and catholyte zones which respectively communicate with external headers for each of set of zones. The outlet headers in this document are therefore internal headers, whilst the external headers as described are collection headers which collect the products from multiple outlet headers.

U.S. Pat. No. 3,463,722 discloses a tapered external header which runs perpendicular to the different electrolysis chambers and collects product from each. As shown in FIG. 4 or 12-16 each cell has a separate internal outlet header which communicates with the common external collection header.

US 2006/108215 describes a microchannel electrochemical reactor in which the internal headers are tapered.

US 2004/118677 describes a filter press electrolyser for electrolysis of water which has a tapered internal header.

It has now been found that an improved electrode assembly may be obtained by providing one of the anode and cathode with an external outlet header whilst providing the other with an internal outlet header.

Thus, in a first aspect, the present invention provides an electrode assembly comprising an anode structure and a cathode structure, each of said anode structure and cathode structure comprising i) a flange which can interact with a flange on an another electrode structure to hold a separator in between the two, ii) an electrolysis compartment which contains an electrode, and which in use contains a liquid to be electrolysed, iii) an inlet for the liquid to be electrolysed and iv) an outlet header for evolved gas and spent liquid, wherein the outlet header on one of the anode structure and the cathode structure is an external outlet header and the outlet header on the other one of the anode structure and the cathode structure is an internal outlet header.

The first aspect of the present invention relates to an electrode assembly comprising an anode structure and a cathode structure. As used herein the term "electrode assembly" means an assembly of a single anode structure and a single cathode structure. The term "electrode assembly" encompasses both bipolar electrode units and electrode modules depending on how the anode and cathode are connected.

To aid in understanding of such structures and of the present invention generally the following further definitions apply herein:

"bipolar electrode unit" is an electrode assembly comprising an anode structure and a cathode structure which are electrically connected to each other. Bipolar electrode units may be connected to adjacent bipolar electrode units via a separator and sealing means between flanges on the adjacent units to form a filter press electrolyser.

"electrode module" is an electrode assembly comprising an anode structure and a cathode structure which are separated by a separator between the respective flanges. The electrode module is provided with a sealing means to achieve a liquid and gas tight seal between the separator and the respective flanges. Electrode modules may be electrically connected to adjacent electrode modules to form a modular electrolyser.

"electrode structure" means a single cathode structure or a single anode structure. As defined herein each electrode structure comprises a flange, an electrolysis compartment, an inlet and an outlet header.

"electrolyser", when used by itself, means a filter press electrolyser or a modular electrolyser.

"electrolyser collection header" is a volume which collects the gases evolved during electrolysis from the exits of multiple outlet headers, and passes them to further processing. An electrolyser may have a single electrolyser collection header or multiple electrolyser collection headers, but there are always significantly less electrolyser collection headers than electrode structures.

"electrolyser feed header" is a volume which feeds liquid to be electrolysed to the inlets of multiple electrode structures, such as to the inlets of multiple inlet headers when present. An electrolyser may have a single electrolyser feed header or multiple electrolyser feed headers, but there are always significantly less electrolyser feed headers than electrode structures.

"electrolysis compartment" is a volume within the electrode structure which contains an electrode and which in use contains a liquid to be electrolysed.

"electrode", when used by itself, refers to the electroconductive plate or mesh found in the electrolysis compartment of an electrode structure. The same applies to the terms "anode" and "cathode" when used by themselves.

"external outlet header" means an outlet volume by which gases evolved during electrolysis exit the electrode structure and which is provided on the electrode structure outside of the electrolysis compartment.

"filter press electrolyser" means a plurality of connected bipolar electrode units, adjacent bipolar electrode units being connected via a separator and sealing means between flanges on the adjacent units.

"inlet" as used herein refers to the inlet by which liquid to be electrolysed enters an electrode structure. Each electrode structure will have at least one inlet. Preferred inlets are in the form of "inlet headers". The inlets of multiple electrode structures of the same type (anode or cathode) may be fed in use from a common electrolyser feed header.

"inlet header" as used herein means an inlet volume which is part of an individual electrode structure by which liquid to be electrolysed enters the electrolysis compartment of the electrode structure. The inlet header is generally an extended volume which is aligned parallel with the long horizontal axis of the electrode structure. The inlets of the inlet headers of multiple electrode structures of the same type (anode or cathode) may be fed in use from a common electrolyser feed header.

"internal outlet header" means an outlet volume by which gases evolved during electrolysis exit the electrode structure and which is provided on the electrode structure inside of the electrolysis compartment.

"modular electrolyser" means a plurality of connected electrode modules.

"outlet header" as used herein means an outlet volume which is provided on an individual electrode structure and by which gases evolved during electrolysis exit the electrode structure. Each electrode structure in an electrolyser will have an outlet header. The outlet header of a particular electrode structure may be internal or external.

"refurbishing" as used herein refers to the repair, recoating and/or replacement of all or part of an electrode.

"sealing means" are structures made from chemically resistant, insulating, compressible substances, such as gaskets, designed to be compressed between a flange and a separator to achieve a liquid and gas tight seal.

"separator" is used to refer to the means which sits between the anode in an anode structure and the cathode in an adjacent cathode structure whilst providing fluid separation between the respective electrolysis compartments of said anode and cathode structures. The separator is preferably an electroconductive membrane, such as an ion-exchange membrane.

Each electrode structure comprises a flange which can interact with a flange on another electrode structure to hold a separator in between the two. Generally, the flange supports a gasket which is capable of sealing the separator between an anode and an adjacent cathode in an electrode module or between bipolar electrode units in a filter press electrolyser.

Although preferred and advantageous more specific features of the present invention are described further below, other than the requirements on the respective headers in the present invention, the electrode structures are preferably broadly as defined in U.S. Pat. No. 6,761,808.

As described in U.S. Pat. No. 6,761,808 such a structure allows very small or even zero anode/cathode gaps to be used without damage to the separator, and minimises electrical resistance by using a short perpendicular current-carrying path length between electrodes and low resistance materials for almost the entire perpendicular current-carrying path length and which affords excellent current distribution throughout the electrode area. The electrode structure permits both horizontal and vertical flow of liquors therein aiding circulation and mixing thereof and has improved rigidity and strength which allows closer tolerance to be achieved in cell construction, and also is of simple construction and easy to fabricate.

For example, each electrode structure preferably comprises a pan with a dished recess, wherein the flange is around the periphery of the pan, and an electrode spaced apart from the pan.

Each electrode structure comprises an electrolysis compartment, which is a volume within the electrode structure which contains an electrode and which in use contains a liquid to be electrolysed. In use of an electrode structure comprising a pan with a dished recess wherein the flange is around the periphery of the pan, the electrolysis compartment is the volume formed by a pan on one side, and by a separator held between the electrode and an adjacent electrode on the other side. In particular the flange can support a gasket capable of sealing the separator between the anode of an anode structure and the cathode of a cathode structure such that the anode is substantially parallel to and faces but is spaced apart from the cathode by the separator and the electrode structures are hermetically sealed to the separator at the flange.

The gaskets for sealing the separator between the flanges are generally as known in the art. They may be different in the anode and cathode structures, but are typically made from a suitable material with appropriate chemical resistance and physical properties, such as a plasticised EPDM resin. Where a material does not have a suitable combination of chemical resistance and physical properties a gasket made from a material having suitable physical properties may be provided with a chemically resistant liner, for example made of PTFE, on its inner edge.

The gasket may be in the form of a frame, preferably continuous, such that when two gaskets are disposed either side of a separator and a load applied thereto via the pans hermetic sealing of the module is effected.

The gasket may contain holes to accommodate sealing bolts.

The separator is preferably a substantially electrolyte-impermeable ion-exchange membrane. However, we do not exclude the possibility that it may be a porous electrolyte-permeable diaphragm. Ion permselective membranes for chlor/alkali production are well known in the art. The membrane is preferably a fluorine-containing polymeric material containing anionic groups. Preferably it is an anion group-containing polymer containing all C—F and no C—H bonds. As examples of suitable anion groups may be mentioned $—PO_3^{2-}$, $—PO_2^{2-}$, or preferably $—SO_3—$ or $—COO^-$.

The membrane may be present as a mono- or multi-layer film. It may be reinforced by being laminated with or coated onto a woven cloth or microporous sheet. Furthermore, it may be coated on one or both sides with a chemically resistant particulate coating to improve wetting and gas release.

Where a membrane bearing a surface coating is employed in chloralkali applications the surface coating is typically formed from a metal oxide inert to the chemical environment, e.g. zirconia Suitable membranes for chloralkali applications are sold, for example, under the tradenames "Nafion" by The Chemours Company LLC (a subsidiary of E I Du Pont de Nemours and Company), "Flemion" by the Asahi Glass Co. Ltd. and "Aciplex" by the Asahi Kasei Co. Ltd.

The electrode is a formed or perforated electroconductive plate or mesh. In operation electrolysis is carried out on the electrode. Preferably the electrode is coated with an electrocatalytic coating to facilitate electrolysis at lower voltages. Electrodes may be anodes or cathodes depending on whether the electrochemical reaction they are promoting is oxidative or reductive.

The dished recess may have projections which allow one electrode structure to mate with an adjacent electrode structure. The projections in the dished recess are preferably spaced apart from each other in a first direction and in a direction transverse to the first direction.

Preferred recess and projections in the present invention are broadly as defined in U.S. Pat. No. 6,761,808. For example, preferably the dished recess of one of the anode structure and cathode structure is provided with a plurality of outwardly projecting projections and the other of the anode structure and cathode structure is provided with a plurality of inwardly projecting projections the projections being such that the outwardly projecting projections can mate with the inwardly projecting projections in an adjacent electrode structure or electrode module in a modular electrolyser. ("Inward" as used in this context refers to projections which project from the recess in to the electrolysis compartment, whereas "outward" refers to projections which project from the recess out from the electrolysis compartment.)

Preferably the cathode structure comprises a dished recess provided with a plurality of outwardly projecting projections and the anode structure comprises a dished recess provided with a plurality of inwardly projecting projections.

The projections in the dished recess are preferably spaced apart from each other in a first direction and in a direction transverse to the first direction. More preferably the projections are symmetrically spaced apart. For example, they may be spaced apart by an equal distance in a first direction, and spaced apart by an equal distance, which may be the same, in a direction transverse, for example substantially at right angles, to the first direction. Preferably the spacing apart of the projections is the same in both directions.

Preferably each projection in a dished recess is electroconductively connected to an electrically conductive member such that the projections provide many current feedpoints hence improving current distribution across the pan leading to lower voltage, lower power consumption and longer separator and electrode coating lives.

The projections in the dished recess may have a variety of shapes, for example dome, bowl, conical or frusto-conical. The preferred shape in the present invention is frusto-spherical. Such projections are simple to manufacture whilst providing improved resistance to pressure.

In the present invention there are typically about 20-200, preferably 60-120, projections/metre squared on the dished recess of the pan of the electrode structure.

The height of the projections from the plane at the base of the dished recess may for example be in the range 0.5-8 cm, preferably 1-4 cm, depending on the depth of the pan. The distance between adjacent projections on the recessed dish may for example be 1-30 cm centre to centre, preferably 5-20 cm. The dimensions of the electrode structure in the direction of current flow are preferably in the range 1-6 cm, as measured from the electrode to the plane at the base of the dished recess, in order to provide short current paths which ensure low voltage drops in the electrode structure without the use of elaborate current carrying devices.

The inlet for liquid according to the present invention may be any suitable inlet, for example one or more tubes. It generally resides at the lower part of the electrode structure. For example, it may be provided at the bottom of the electrode structure extending lengthwise along the width of the structure from one side thereof to the other, to allow liquid to be charged thereto. Where the modular bipolar electrolyser is to be used for brine electrolysis the inlet allows caustic to be charged to the cathode structure and brine to be charged to the anode structure. Ports may be spaced along the length of an inlet to improve liquid feed distribution across the width of the electrode structure. The number of ports for any particular application may be readily calculated by the skilled man.

Evolved gases are discharged from the electrode structures through an outlet header. Although the outlet headers are defined herein in relation to gases evolved during electrolysis spent liquid/liquor is generally also discharged through the outlet header with the evolved gases. In the outlet header gas/liquid separation occurs such that the gas and liquid can be separately recovered. The gas and liquid streams leave the outlet header through one or more exit ports, preferably one exit port, more preferably disposed at one end thereof.

The gas and liquid streams generally exit the outlet header into an electrolyser collection header, which passes them to further processing. The exits of the outlet headers of multiple electrode structures of the same type (anode or cathode) are generally joined in use to a common electrolyser collection header. An electrolyser may have a single electrolyser collection header or multiple electrolyser collection headers, but there are always significantly less electrolyser collection headers than electrode structures. For avoidance of doubt, as defined herein an outlet header is a separate and distinct feature from an electrolyser collection header, not least because each electrode structure comprises an individual outlet header, whereas a single electrolyser collection header collects gas from multiple electrode structures.

A further point of distinction which arises is in the orientation of outlet headers and collection headers.

In particular, each outlet header according to the present invention is generally an extended volume which is aligned parallel with the long horizontal axis of the electrode structure. This enables the outlet header to communicate with (and thereby remove evolved gas and spent liquid) at multiple points along the length of the electrode structure, which provides more efficient removal.

In contrast, an electrolyser collection header is generally aligned in a direction perpendicular to the long horizontal axes of individual electrode structures because its objective is to collect evolved gas (and liquid) from multiple outlet headers from multiple electrode structures, In the present invention the outlet header on one of the anode structure and the cathode structure is an external outlet header and the outlet header on the other one of the anode structure and the cathode structure is an internal outlet header.

For avoidance of doubt, whilst an electrode assembly as claimed comprises both an electrode structure with an external outlet header and an electrode structure with an internal outlet header, the individual electrode structures preferably comprise only an internal outlet header as defined herein or only an external outlet header as defined, but not both internal and external outlet headers on the same electrode.

In the present invention "internal outlet header" refers to an outlet volume provided on the electrode structure inside of the electrolysis compartment. Internal outlet headers are generally less costly to manufacture because they need less metal. Further, electrode structures with internal outlet headers have the advantage of a higher pressure rating, and operating at higher pressure allows a lower voltage. The internal outlet header is preferably located at or close to the top of the electrolysis compartment. Preferably the top of the internal outlet header resides below the upper level of the flange on the electrode structure. The internal outlet header generally communicates with the electrolysis area via one or more exit apertures or slots. Preferably, during electrolysis the gas/liquid mixture obtained by the electrolysis flows upwardly through the electrolysis compartment and then spills horizontally from the top of the electrolysis area into the internal outlet header through one or more exit apertures or slots formed between the top of the outlet header wall and the top of the electrolysis compartment.

The gas/liquid mixture separates out rapidly in the internal outlet header, which preferably runs along substantially the entire width of the electrode structure.

The internal outlet header preferably has a generally rectangular cross-section. The height and width of the exit apertures or slots and the cross-sectional area of the outlet header can be chosen in the light of inter alia the current density, electrode area and temperature such that it fits within the depth of the electrolysis compartment, providing sufficient space for liquors and gasses to circulate freely therein, whilst allowing sufficient space in the header itself to ensure that stratified horizontal gas/liquid flow along the header, preferably with a smooth interface, is maintained.

The internal outlet header may have one or more discrete depth dimensions, depending on its shape. Typically the maximum depth of the internal outlet header is between 30%-85% of the depth of the electrolysis compartment, more preferably between 50%-70% of the depth of the electrolysis compartment. The height of the internal outlet header is specified so as to achieve the required cross sectional area subject to the shape and depth of the outlet header. ("Depth" as used in this context is measured along an axis which is perpendicular to the plane of the back wall of the electrode pan, whilst "height" is measured along an axis in the plane of the back wall of the electrode pan which is vertical when the pan is in operation. (The third dimension is "width" and is measured along an axis in the plane of the back wall of the electrode pan which is horizontal when the pan is in operation measured.)

The exit apertures or slots are designed to ensure that the gas phase is dispersed as bubbles in a continuous liquid phase in the electrolysis compartment and through the exit slots without premature gas disengagement or slugging. The height of the exit slot is typically from 2-20 mm, preferably 5-10 mm. Where more than one exit slot is provided they are preferably dispersed evenly across the width of the electrolysis compartment. Preferably the total length of the exit slot or slots is greater than 70% of the width of the electrolysis compartment, more preferably greater than 90%. Most preferably a single exit slot is provided extending the entire width (100%) of the electrolysis compartment.

The internal outlet header preferably communicates with the external pipework via a single orifice.

The use of an external outlet header on one of the electrodes has the advantage that the upper region of the electrolysis compartment can be kept "liquid full" and hence damage to the separator caused by formation of a gas space adjacent the separator in the upper region of the electrolysis compartment is reduced, and often eliminated.

Further, because the respective gases do not collect in the top of the electrolysis compartment on both sides of the separator the invention eliminates any risk of gas from one side seeping through to the other. For example, with hydrogen and chlorine this could lead to the risk of forming an explosive mixture of the two. (Typically as a result of hydrogen migration because the hydrogen side of the separator is usually run at a slightly higher pressure than the chlorine side.)

In the present invention "external outlet header" refers to an outlet volume which is provided on the electrode structure outside of the electrolysis compartment. Preferably the bottom of the external outlet header resides above the upper level of the electrolysis compartment.

Generally, in the external outlet header the gas/liquid mixture flows upwardly from the electrolysis area through one or more exit apertures or slots at the top of the electrolysis compartment and into the external outlet header. A surface level of fluid may be maintained in the external outlet header. In a preferred embodiment, the external outlet header is provided along substantially the entire width of the electrode structure. The one or more exit slots preferably run along essentially the same width as the external outlet header.

The depth of the exit slots will be chosen in the light of inter alia the current density electrode area and temperature such that the gas phase is dispersed as bubbles in a continuous liquid phase. The depth of the exit slot is typically about 5-70%, preferably about 10-50%, of the depth of the electrolysis compartment structure i.e. the distance between the plane through the bottom of the dished recess and the separator where present.

The gas/liquid mixture separates out rapidly in the external outlet header, which runs along substantially the entire width of the electrode structure.

The outlet header preferably has a generally rectangular cross-section. The cross-sectional area of the outlet header can be chosen in the light of inter alia the current density, electrode area and temperature such that stratified horizontal gas/liquid flow along the header, preferably with a smooth interface is maintained.

It has now been found however that an improved electrode structure with an external outlet header can be obtained if the ratios $V_E/(A_E \times L_E)$ is less than 1, where $V_E$ is the internal volume of the external outlet header in $cm^3$, $A_E$ is the internal cross sectional area at the exit end of the header $L_E$ is the internal length.

As used herein, the length, volume and area are determined internally on the external header. The internal length is the minimum internal straight-line distance from the exit end to the opposite end of the header. In the present invention the length, cross-sectional area and the volume should be determined ignoring the presence of any internals in the header. In terms of the volume, $V_E$ is defined as the total volume contained within the electrode structure above a plane running horizontally along the axis in the same direction as the length of the header and located at the bottom of the trough which channels gasses and liquors produced by the electrode to the exit end.

In conventional headers with constant cross-section along their length e.g. rectangular, then $V_E/(A_E \times L_E)$ is equal to 1.

$V_E/(A_E \times L_E)$ less than 1 can be achieved by having a header which has a non-constant cross-section along its length.

More preferably $V_E/(A_E \times L_E)$ is less than 0.95. There is no specific lower limit but $V_E/(A_E \times L_E)$ may be generally less than 0.7, such as as low as 0.4.

$V_E$ is typically less than 3100 $cm^3$, such as less than 2800 $cm^3$, for example 2300 $cm^3$.

$A_E$ is preferably at least 7 $cm^2$ and preferably at least 15 $cm^2$.

The length of the anode $L_E$ is typically greater than 50 cm and preferably greater than 150 cm such as 230 cm.

The volume, length and internal cross sectional area at the exit end of the internal outlet header ($V_I$, $L_I$ and $A_I$) may also be such that $V_I/(A_I \times L_I)$ is less than 1, for example less than 0.75. There is no specific lower limit but $V_I/(A_I \times L_I)$ may be generally less than 0.55, such as as low as 0.35.

In a preferred embodiment the ratio $V_E/(A_E \times L_E)$ less than 1 is achieved by making the external outlet header tapered such that its cross-sectional area increases along its length towards the exit end. It will however be apparent that other options, such as header with step reductions in cross-section can also obtain the required relationship.

For example, a tapered header can use less metal when compared to a non-tapered outlet header. A further advantage of the tapered external outlet header is that less reinforcement is required by way of increased metal thickness or by the addition of internal supports to make it capable of operating at higher pressures, hence reducing cost of manufacture.

A further particular advantage of the present invention, where only one of the anode outlet header and cathode outlet header is an external outlet header, is that there is more space above an electrode module or a bipolar electrode unit for the single outlet header which is present, which enables more flexibility in the design thereof, and in particular in the horizontal depth thereof. (For avoidance of doubt, "depth" as used in the context of the header, for consistency with the use of the term for the electrode structure generally, is measured along an axis which is perpendicular to the plane of the back wall of the electrode pan,) This enables further improvements in separation to be obtained in the header.

For example, the depth of the external outlet header can exceed the depth of the electrolysis compartment of the electrode structure to which it is attached. As a particular example, the external outlet header of the electrode structure which has said external outlet header can occupy space which is vertically above the adjacent electrode structure in an electrode module, bipolar electrode unit, modular electrolyser or filter press electrolyser.

Furthermore the use of an internal outlet header reduces the thickness of metal needed to make the electrolyser capable of running at elevated pressure compared to the alternative of two external headers because the internal header does not have to be pressure resistant. Therefore less metal and thinner metal can be used for the internal outlet header.

In a particular preferred embodiment, the outlet header on the anode structure is an external outlet header and the outlet header on the cathode structure is an internal outlet header. This is preferred because it has been found that the separator is most prone to damage caused by the formation of a gas space adjacent the separator on the anode side in the upper region of the electrolysis compartment, and also because the separation of formed chlorine from spent brine is the most problematic. This is due to, for example, the density, viscosity and surface tension of the chlorine gas/liquid brine mixture, and in particular the mixture of chlorine and brine is most prone to foaming.

The external outlet header located above the electrolysis compartment allows to minimise these problems because its location moves the gas disengagement area away from the separator and also provides increased flexibility to design its shape and size to improve the separation.

One or both of the outlet headers may comprise one or more internal cross members, and in particular cross-members may be located along part of or all of the length of and attached internally to the sides of the header. Preferably the cross members are strips running internally, for example horizontally, along the length of the outlet header(s), attached to the sides of the header(s). The cross members may be provided with holes through the strips communicating from top to bottom.

Such cross members may be provided, for example, to increase the pressure rating of the headers. It is preferred that at least the external outlet header comprises one or more such internal cross members.

It has been found however that the cross-members can also help to improve the separation in the header. Thus, even where improved pressure rating is not required, such as in the internal header, the use of cross-members is advantageous and is preferred.

In the preferred electrode structure comprising a pan with a dished recess (wherein the flange is around the periphery of the pan, and with an electrode spaced apart from the pan) electrically conducting pathways are formed between the dished recess and the electrode.

In one embodiment electrically conductive posts (hereinafter simply "posts") may connect the dished recess directly to the electrode.

The electrically conducting pathways are preferably formed via current carriers comprising a central portion from which one or more legs radiate, and where the ends of the legs (feet) of the current carriers are electrically connected to the electrode.

In most preferred embodiments the electrically conducting pathways comprise one or more current carriers each comprising a central portion from which one or more legs radiate and where the ends of the legs (feet) of the current carriers are electrically connected to the electrode and the central portions are electrically connected to the dished recess of the pan. The central portions are preferably electrically connected to the dished recess of the pan via posts i.e. the electrically conducting pathways are formed via posts from the projections of the dished recess to current carriers each comprising a central portion from which one or more legs radiate and where the ends of the legs (feet) of the current carriers are electrically connected to the electrode.

Again such a configuration is as generally described in U.S. Pat. No. 6,761,808.

For example, the current-carrier is preferably a multi-legged current-carrier comprising a central portion from which multiple legs radiate, and where the ends of the legs (feet) of the current carriers are electrically connected to the electrode, hereinafter referred to for convenience as a "spider". The electrical connections may be made without using a post; for instance, in the case of an anode structure, the apex of each inwardly directed projection may be electrically connected to the anode plate by means of a current carrier. The use of posts and current carriers is preferred.

The provision of spiders increases the number and distribution of current feed points to the electrically conductive plate, hence improving current distribution leading to lower voltage and power consumption and longer life of separators and electrode coatings. The length of the legs and the number thereof on the spiders, where a spider is present, may vary within wide limits. Typically each spider contains between 2 and 100 legs, preferably between 2 and 8 legs. Typically each leg is between 1 mm and 200 mm long, preferably between 5 mm and 100 mm long. The skilled man by simple experiment will be able to determine suitable lengths and numbers of spider legs for any particular application.

A spider may be flexible or rigid. The shape and mechanical properties of the spiders in the anode structure may be the same as or different from the shape and mechanical properties of the spiders in the cathode structure. In a preferred embodiment the legs of the current carriers associated with the anode structure may be shorter than the legs of the current carriers associated with the cathode structure, such as 5-50% shorter, preferably 10-30% shorter. For example, relatively non-springy spiders with short legs are often preferred in the anode structure and relatively springy spiders with long legs are preferred in the cathode structure.

The use of spring-loaded spiders, at least at the cathode plate, enables the electrode structures to be spring-loaded to achieve zero gap operation with optimum pressure to minimise risk of separator/electrode damage. By "zero gap", we mean that there is substantially no gap between the electroconductive plate of the each electrode structure and the adjacent separator, i.e. so that adjacent electroconductive plates are in use only separated by the thickness of the separator.

The use of such a configuration with posts and current carriers is also advantageous in allowing the electrode to be disconnected and replaced.

The anode current carrier may be fabricated from a valve metal or an alloy thereof. "Valve metals" are metals which grow a passivating oxide layer when exposed to air. The commonly understood valve metals, and those defined by the use of the term herein, are Ti, Zr, Hf, Nb, Ta, W, Al and Bi. The anode current carrier is preferably fabricated from titanium or an alloy thereof.

The cathode current carrier may be may be fabricated from materials such as stainless steel, nickel or copper, especially nickel or an alloy thereof.

Each current carrier is preferably made from the same metal as the electrically conductive plate with which it is in electrical contact and more preferably each post with which it is in contact is also made of the same metal.

The post in an anode structure ("anode-post") may also be made of a valve metal therefore, and is preferably made of titanium or an alloy thereof whilst the post in a cathode structure ("cathode-post") may be made of stainless steel, nickel or copper, especially nickel or an alloy thereof. In such a scenario the length of the electrically conductive pathway through the cathode-post is preferably greater than the length of the electrically conductive pathway through the anode post. Preferably the ratio of the length of the electrically conductive pathway through the cathode post to the length of the electrically conductive pathway through the anode post is at least 2:1, preferably at least 4:1 and more preferably at least 6:1. This is most readily achieved by the use of a cathode structure which comprises a dished recess provided with a plurality of outwardly projecting projections whilst the anode structure comprises a dished recess provided with a plurality of inwardly projecting projections.

The posts and the central portion of the current carriers may be load bearing, and where they are load bearing they are preferably are aligned with holes in the electrode. Electrically-insulating, load-bearing pins may be provided, disposed at the ends of the posts/current carriers adjacent the electrode.

Corresponding posts and pins can be provided in an adjacent electrode structure such that, when connected with a separator in between, load is transmitted from a post/current carrier/pin combination on one side of the separator, via the separator, to a pin/carrier/post combination on the other side of the separator. The load helps to maintain a good electrical connection between the pan on one side of the separator and the pan in the adjacent electrode structure, whilst the insulating pins transfer the load through the separator without causing mechanical damage to it. Since electrolysis does not occur at these points, the separator does not suffer from any electrolysis damage.

The preferred configuration is shown in FIGS. 1-6 as discussed further below.

The insulating pins may be made from entirely from an insulating material or may be made from a conductive material fitted with an insulating cap or cushion adjacent the membrane.

Such insulating cushions may be made from a non-conductive material which is resistant to the chemical environment within the cell, e.g. fluoropolymers such as PTFE, FEP, PFA, polypropylene, CPVC and fluoroelastomeric rubbers. The cushions may be provided on metal studs which are located with the cushion presented towards the separator.

In particular, in the cathode structure the load bearing insulating pins may be made from nickel fitted with insulating fluoropolymer caps and in the anode structure the load bearing insulating pins may be made from titanium fitted with insulating fluoropolymer caps.

The current carriers are preferably designed such that in an electrode module comprising an anode structure and a cathode structure assembled with sealing means and a separator, in the area between adjacent rows and columns of recesses the maximum distance of any point on the separator from the nearest foot of a current carrier attached to the anode or from the nearest foot of a current carrier attached to the cathode is 50 mm or less, such as 30 to 50 mm.

In a further preferred embodiment, the legs or feet of the current carriers in one of the anode structure and the cathode structure are resilient whilst the current carriers on the other of the anode structure and the cathode structure are rigid, such that when an anode structure and a cathode structure are separated by a separator between the two structures, the resilient legs or feet apply pressure from the electrode of one structure via a separator to the electrode of the other. Preferably, the pressure applied by one electrode to the other (via the separator) is greater than 0 $g/cm^2$ and less than 400 $g/cm^2$, such as less than 100 $g/cm^2$, and more preferably greater than 10 $g/cm^2$ and/or less than 40 $g/cm^2$.

The ability to provide low levels of pressure using resilient legs/feet is advantageous because it enables pressure to be applied with minimum risk of damage to the separator.

In general, in a particular electrode structure the pan, the electrode, the inlet and outlets for fluids and the electrically conductive pathways are all made from the same material. In an anode structure this is preferably titanium. In a cathode structure this is preferably nickel.

Either or both electrode structures may be fitted with baffles, for example so as to partition the electrode structure into two communicating flow zones extending vertically up the electrolyser which facilitate increased rates of internal liquor circulation by employing hydrodynamic lift.

For example, one or more baffles are preferably provided in the anode and cathode structures to form a first channel between a first side of the baffle and the electrode plate and a second channel between the second side of the baffle and the recessed dish of the pan, the first and second channels being in communication with each other, preferably at least at or adjacent the top and bottom of the electrode structure. The first channel provides a riser for the gas-filled brine to ascend to the outlet header at the top of the electrode structure. The second channel provides a downcomer for the degassed brine to fall to the bottom of the electrode structure. The baffles are preferably disposed vertically. The baffles utilise the gas-lift effect of the generated gas to enhance liquor circulation and mixing which produces certain advantages.

Improved mixing in the anode and cathode structures minimises concentration and temperature gradients within the structures thus increasing anode coating and membrane lifetime. In particular, in the anode structure the improved mixing allows the use of highly acidic brine to obtain low levels of oxygen in chlorine without the risk of damage to the membrane via protonation. The improvement in mixing in the cathode structure allows direct addition of de-ionised water to keep the concentration of caustic level constant after concentrated caustic is removed.

The provision of an inclined baffle plate in the upper region of the electrode structure further increases gas/liquid separation by accelerating the upward flow of the gas/liquid mixture from the electrolysis area thus enhancing gas bubble coalescence.

The baffles are made of material which is resistant to the chemical environment in the cell. The baffles in the anode structure may be made of a fluoropolymer or a suitable metal, for example titanium or an alloy thereof. The baffles in the cathode structure may be made of a fluoropolymer or a suitable metal, for example nickel.

In a preferred embodiment, a shoulder can be provided on the conductive posts connected to the current carriers. This can facilitate installation of baffles in the electrode structure, which makes manufacturing easier.

The electrode assembly according to the present invention may be a "bipolar electrode unit" or an "electrode module" depending on how the anode and cathode are connected.

A bipolar electrode unit comprises an anode structure and a cathode structure which are electrically connected to each other. Preferably, in particular using the preferred electrode structures comprising a pan with a dished recess, the recessed dish of the anode pan and the recessed dish of the cathode pan are electrically joined, preferably at the apices of the projections.

Electrical conductivity may be achieved by the use of interconnectors or by close contact between the electrode structures. Electrical conductivity may be enhanced by the provision of conductivity-enhancing materials or conductivity-enhancing devices on the outer surface of the pans. As examples of conductivity-enhancing materials may be mentioned inter alia conductive carbon foams, conductive greases and coatings of a high-conductivity metal. e.g. silver or gold.

Preferably the anode structure and cathode structure in a bipolar electrode unit are electrically connected via welding, explosion bonding or a screw connection.

The present invention is further illustrated by reference to, but is in no way limited by, the following drawings, in which.

Figure 1:
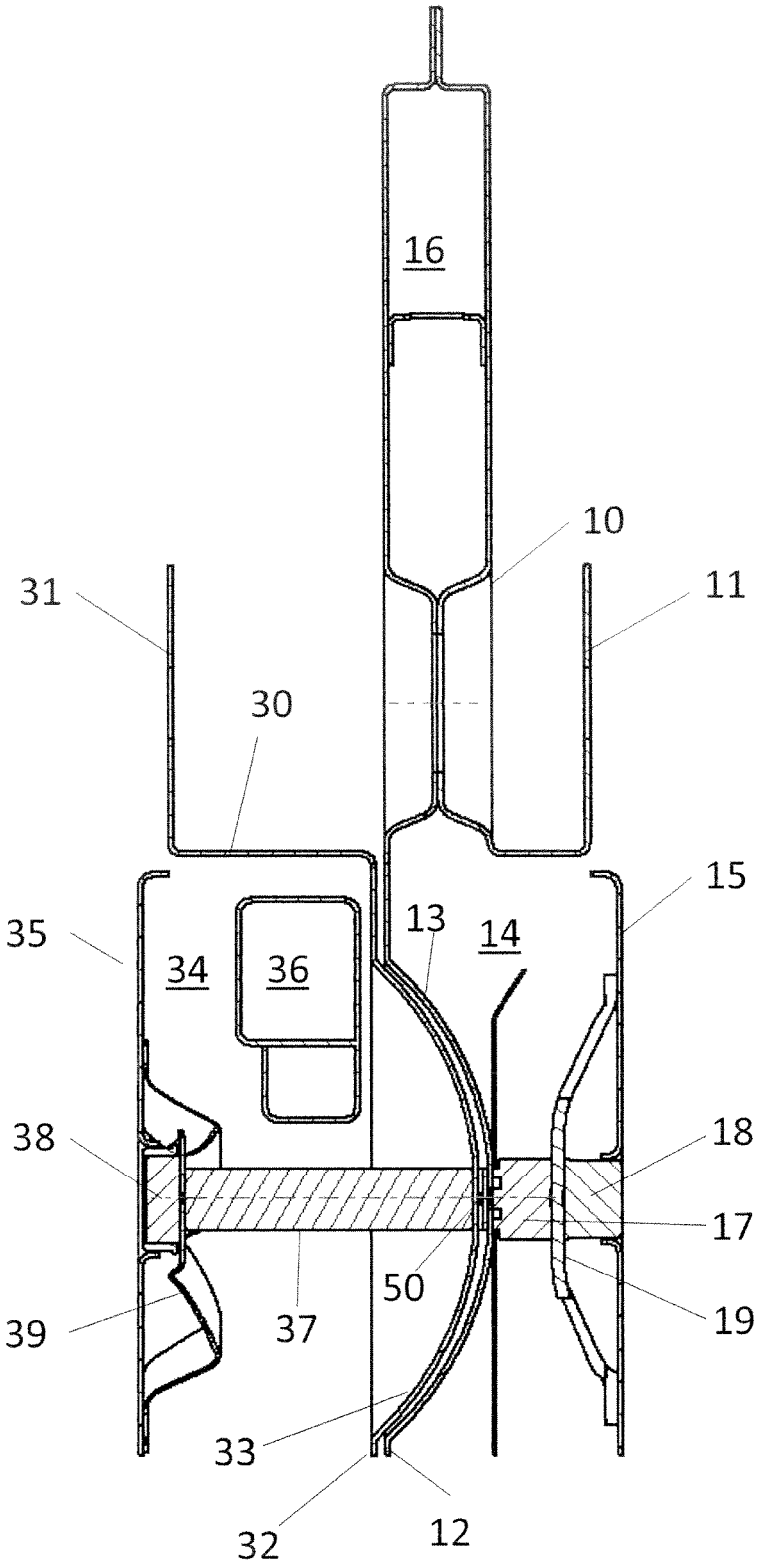
FIG. 1 is a cross-section of the top part of a bipolar electrode unit according to the present invention.

The anode structure (10) comprises a flange (11), and a dished recess (12) with an inwardly projecting projection (13), which forms an electrolysis compartment (14) containing an anode (15). The anode structure has an external outlet header (16). The anode (15) is typically in the form of a perforated plate.

The cathode structure (30) comprises a flange (31), and a dished recess (32) with an outwardly projecting projection (33), which forms an electrolysis compartment (34) containing a cathode (35). The cathode structure has an internal outlet header (36). The cathode (35) is typically in the form of a perforated plate.

The anode structure (10) is electrically connected to the cathode structure (30) via a conductivity enhancing device (50) disposed between the inwardly projecting projection (13) on the anode structure (10) and the outwardly projecting projection (33) on the cathode structure (30).

In practise there are multiple inwardly and outwardly projecting projections on each electrode structure, and multiple conductivity enhancing devices such that when the two electrode structures are urged together, the conductivity enhancing devices afford good electrical continuity between the peaks of the cathode structure projections (33) and the anode structure projections (13). The conductivity enhancing device may be in the form of an abrasion device or (more preferably) a bimetallic disc. When the bipolar electrode unit is supplied pre-assembled for use in a filter press bipolar electrolyser, it is possible for the conductivity enhancing device (50) to be omitted completely and instead for the anode and cathode structure to be electrically and mechanically connected together by welding, explosion bonding or a screw connection.

The anode and cathode structures further comprise electrically conductive posts (17, 37), which connect to the respective projections (13, 33), electrically insulating cushions (18, 38) and current carriers which are each in a form having a central portion from which two or more legs radiate (hereinafter referred to as "spiders")(19, 39). The spiders (19, 39) are mounted between the respective posts (17, 37) and the respective electrodes (15, 35). At the location of the respective posts (17, 37), the electrodes (15, 35) are apertured and the cushions (18, 38) are received within the holes and rest on the central base of the spiders (19, 39).

Flow of liquor from the anode electrolysis compartment (14) to the external outlet header (16) takes place via an exit slot at the upper end of the anode structure (10), the exit slot being located immediately above the anode (15).

Flow of liquor from the cathode electrolysis compartment (34) to the internal outlet header (36) takes place via a slot in the internal outlet header in the upper region of the cathode structure (30).

Figure 2:
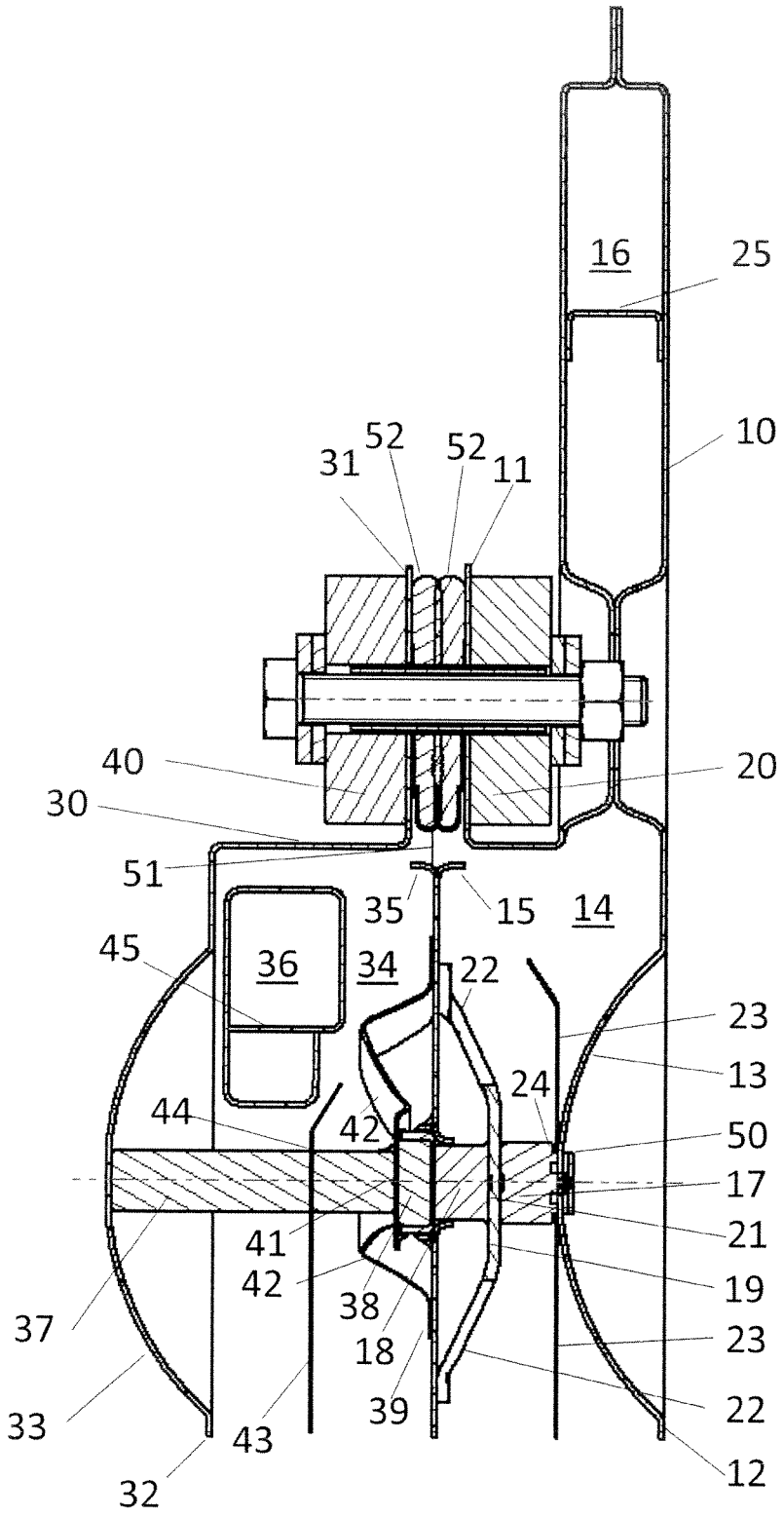
FIG. 2 is a cross-section of the top part of an electrode module according to the present invention.

In FIG. 2 there is shown an electrode module comprising an anode structure (10) and a cathode structure (30). The anode and cathode structures are broadly as defined for FIG. 1 and the same numbering is used as for the corresponding features already described for FIG. 1. However, the respective electrode structures are in this Figure joined with the anode (15) and cathode (35) facing each other with a membrane (51) in between. In particular, the flanges (11, 31) are provided with backing flanges (20, 40) with holes to accept bolts (not shown) for bolting the anode structure (10) and the cathode structure (30) with two gaskets (52) and the membrane (51) to form a module according to the present invention. The membrane (51) passes down through the electrode module between the anode (15) and cathode (35), providing fluid separation between the respective electrolysis compartments (14, 34) of said anode and cathode structures (10, 30).

The spider (19) in the anode electrolysis compartment (14) comprises a disc-shaped central section (21) which can be connected to the end of the post (17), e.g. by welding, screw-fixing or push-fit connectors, and a number of legs (22) which radiate from the central section (21) and are connected at their free ends, e.g. by welding, to the anode (15). Usually the legs (22) are arranged so that the current supply via the post (17) is distributed to a number of equispaced points surrounding the post (17).

The spider (39) in the cathode electrolysis compartment (34) comprises a disc-shaped central section (41) which can be connected to the end of the post (37), e.g. by welding, screw-fixing or push-fit connectors, and a number of legs (42) which radiate from the central section (41) and are connected at their free ends, e.g. by welding, to the cathode (35). Usually the legs (42) are arranged so that the current supply via the post (37) is distributed to a number of equispaced points surrounding the post (37).

In practice, during the production of the electrode structures (10, 30), the spiders (19, 39) may be welded or otherwise connected to the electrodes (15, 35) and the spiders may then be subsequently welded or otherwise secured to the posts (17, 37). This arrangement facilitates replacement or repair of the anode/cathode plates or renewal/replacement of any electrocatalytically-active coating thereon.

Also shown in FIG. 2 are baffles (23, 43) which may serve to partition, respectively, each anode compartment and each cathode compartment into two communicating zones to provide liquor recirculation as discussed further below. The provision of baffles in either compartment is optional, but it is particularly preferred that baffles are provided in the anode compartment. Without wishing to be bound by theory it is believed that recirculation in the anode compartment is useful in providing increased rates of electrolysis, for example by facilitating operation at higher current density.

The baffles (23, 43) may be mounted on the electrically conductive posts (17, 37). Each of the posts may be provided with a shoulder (24, 44) to facilitate installation and accurate location of the baffles.

Also shown in FIG. 2 are a cross-member (25) in the external outlet header (16) of the anode and a cross-member (45) in the internal outlet header (36) of the cathode.

Figure 3A:
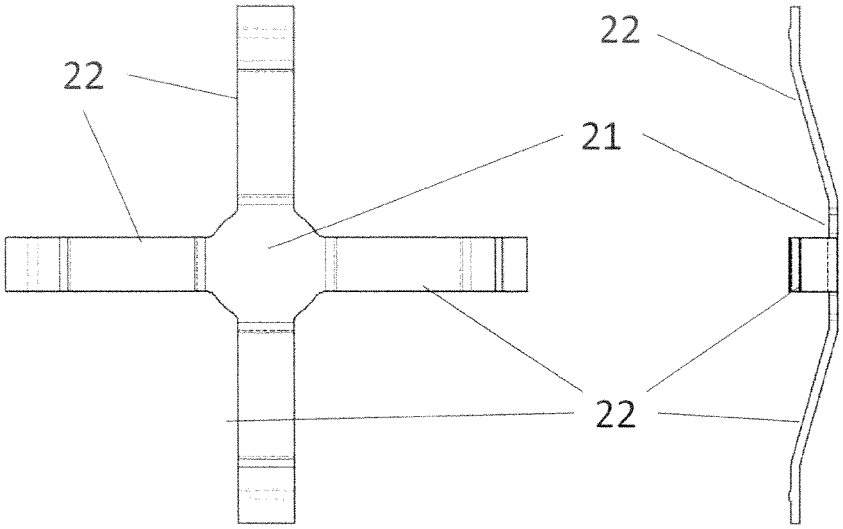
FIGS. 3A and 3B show, respectively, examples of "spiders" suitable for use in the anode and cathode structures.
Figure 3B:
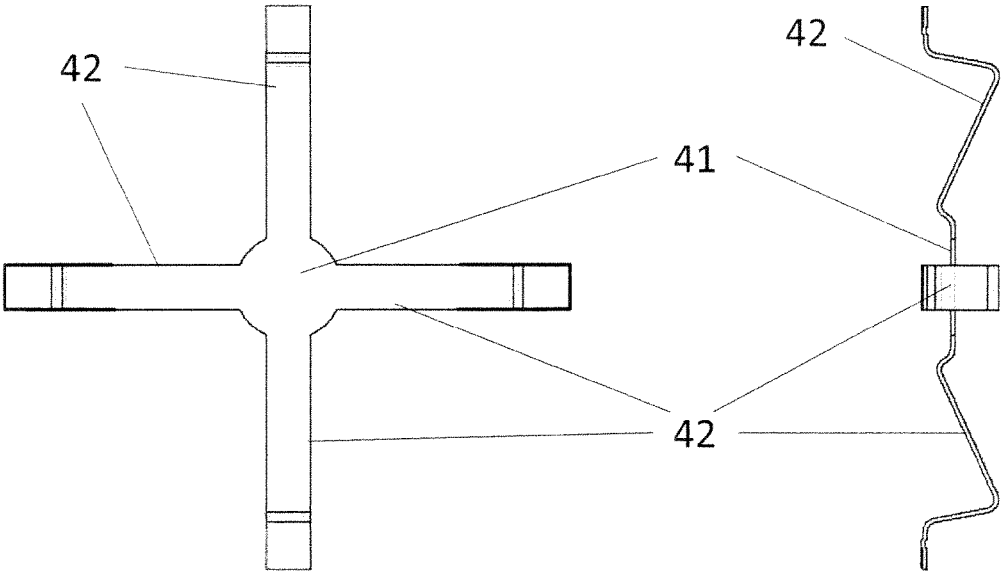

FIGS. 3A and 3B show, respectively, examples of suitable "spiders" for use in the anode and cathode structures.

With respect to FIG. 3A the spider comprises a disc-shaped central section (21) and 4 legs (22) which radiate from the central section (21). The legs (22) radiate symmetrically so that in use the current supply is distributed to a number of equispaced points.

Especially when intended for use in the electrolysis of alkali metal halides, the anode spiders are fabricated from a valve metal or alloy thereof.

With respect to FIG. 3B the spider comprises a disc-shaped central section (41) and 4 legs (42) which radiate from the central section (41). The legs (42) radiate symmetrically so that in use the current supply is distributed to a number of equispaced points.

Especially when intended for use in the electrolysis of alkali metal halides, the cathode spiders may be may be fabricated from materials such as stainless steel, nickel or copper.

As shown, the legs (42) of the cathode spider are longer and configured to be relatively springy, whilst the legs (22) of the anode spider are shorter and more rigid.

Figure 4A:
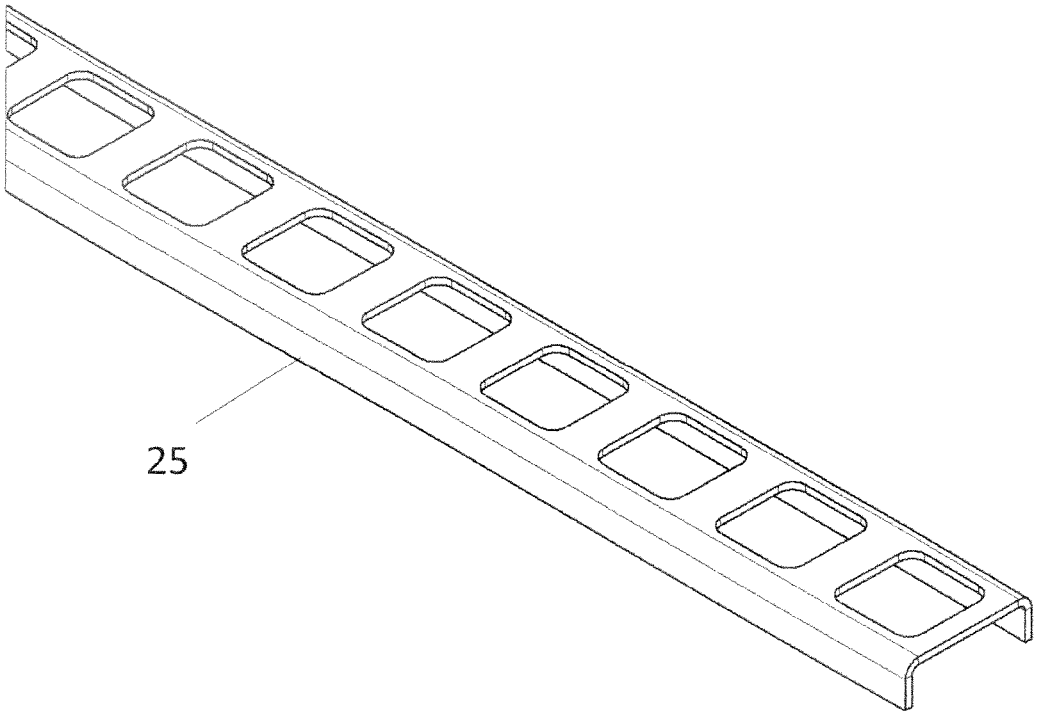
FIGS. 4A and 4B show close-ups of the preferred structures of the cross-members in the external and internal outlet headers.
Figure 4B:
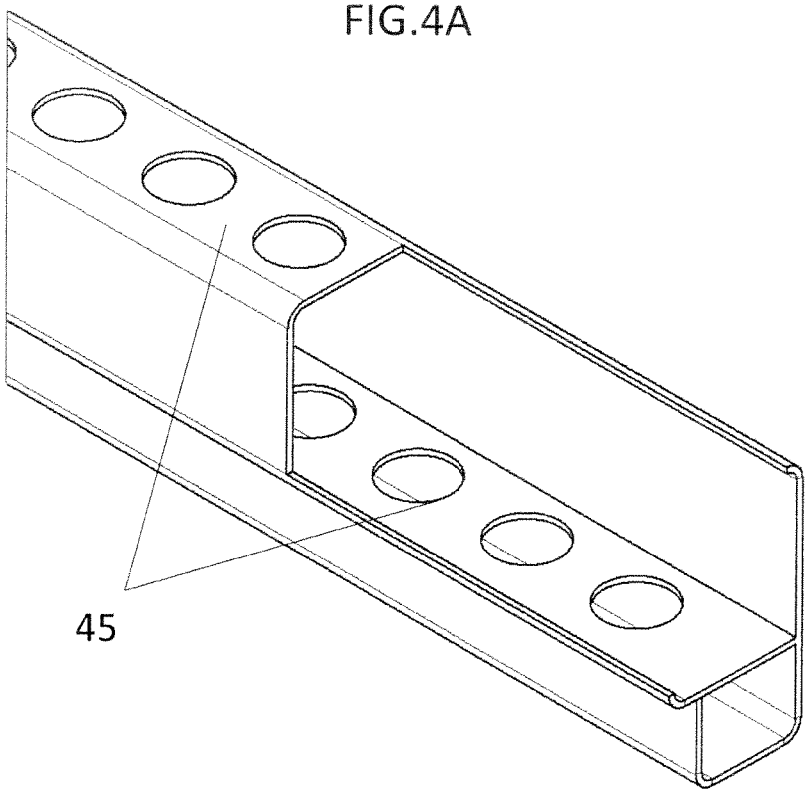

FIGS. 4A and 4B show respectively close-ups of the preferred structures of the cross-members (25) and (45). The preferred structure of the cross-member (25) in the external outlet header (16) is in the form of a "ladder" type arrangement, whilst the preferred structure of the cross-members (45) in the internal outlet header (36) is in the form of plates with round holes. As shown in FIG. 4B, there may be more than one cross-member (45) in the outlet header (36). Although only a single cross-member (25) is shown in FIGS. 1 and 2 there may also be more than one cross-member in the outlet header (16)

Figure 5:
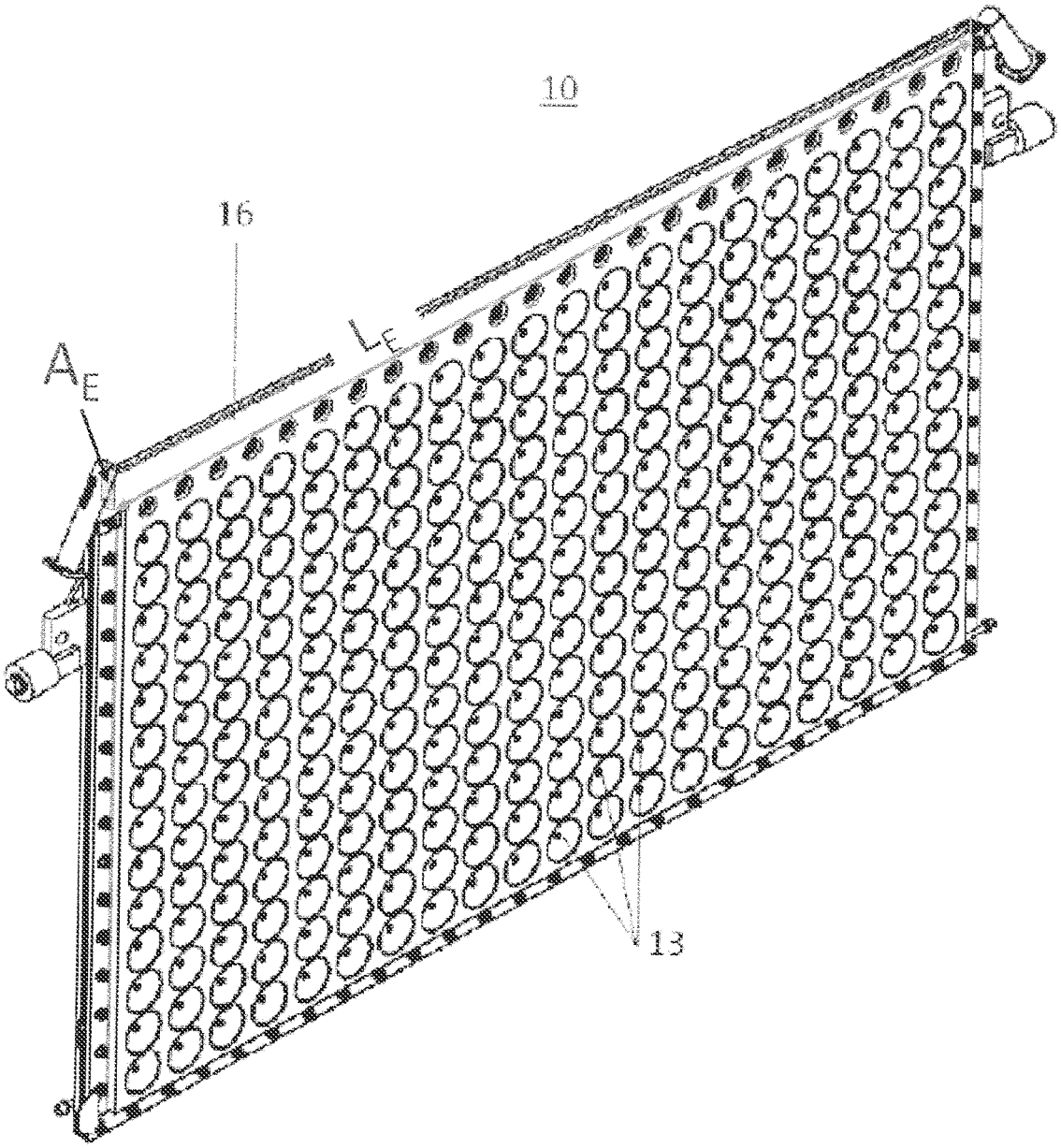
FIG. 5 is an isometric view looking at an anode structure according to the present invention.

FIG. 5 shows an anode structure (10) in more detail, showing inwardly projecting frusto-spherical projections (13) and a tapered external outlet header (16). FIG. 5 also exemplifies the locations for the measurements of the $A_E$ and $L_E$.

Figure 6:
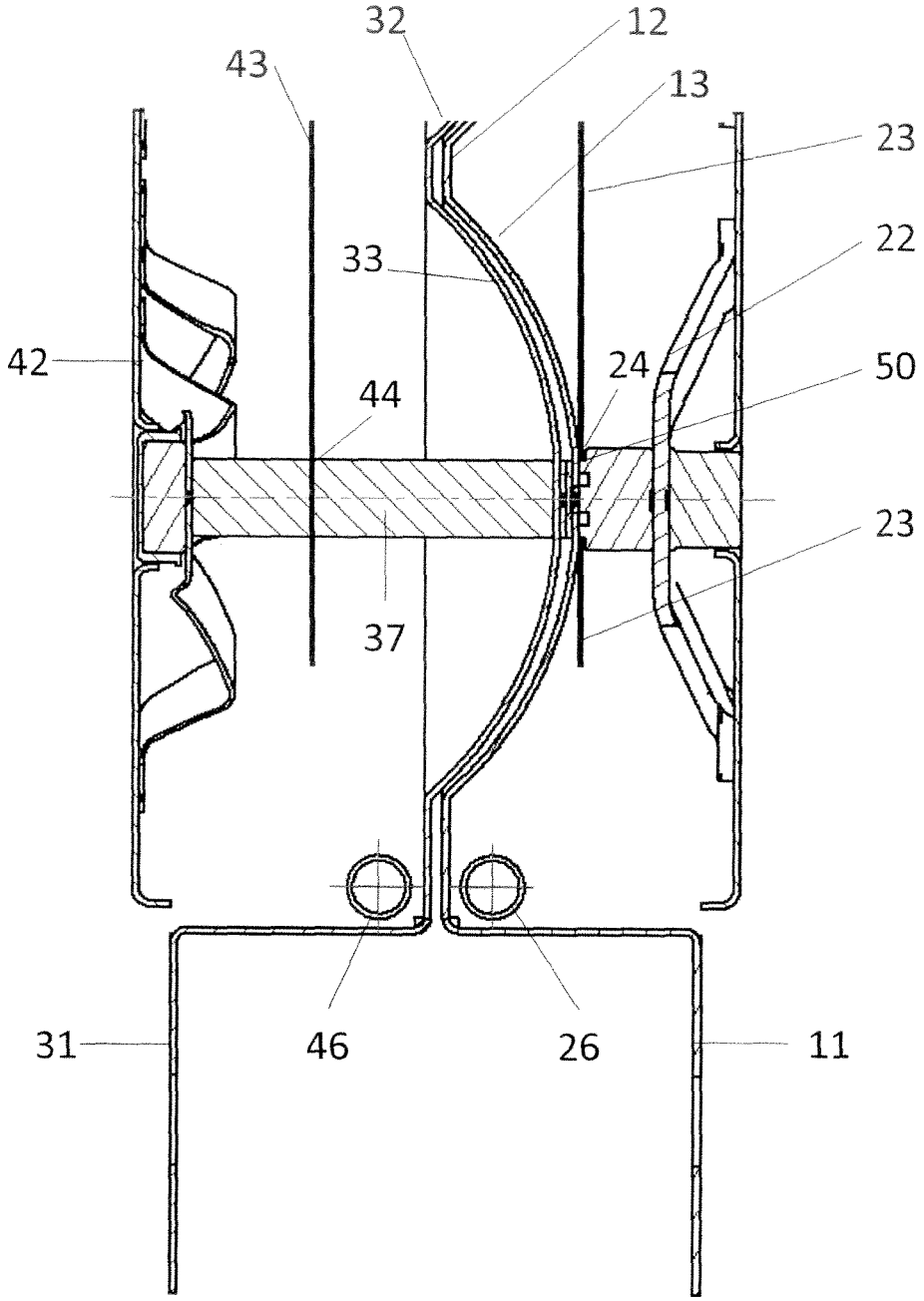
FIG. 6 is a cross-section of the bottom part of a bipolar electrode unit according to the present invention; and In FIG. 1 there is shown a bipolar electrode unit comprising an anode structure (10) and a cathode structure (30).

FIG. 6 shows a cross-section of the bottom part of a bipolar electrode unit. As with the Figures above the same numbering is used as for the corresponding features already described. In this Figure the anode structure is provided with an anode inlet tube (26) whilst the cathode structure is provided with a cathode inlet tube (46). Ports (not shown) are provided in the respective inlet tubes for discharge of liquor into the respective electrolysis compartments, and are preferably formed such that liquor discharged therefrom is directed towards the back of the pans behind the baffles (23, 43) to aid mixing. The baffles (23, 43) extend vertically within the respective anode and cathode compartments from the lower end of the electrode structure to the upper ends thereof and form two channels within each electrode structure which communicate at least adjacent the top and bottom of the structure.

In a second aspect the present invention provides a modular or filter press electrolyser comprising a plurality of electrode assemblies according to the first embodiment.

For example, the present invention may provide a filter press electrolyser comprising a plurality of connected bipolar electrode units, adjacent bipolar electrode units being connected via a separator and sealing means between flanges on the adjacent units. The separator and sealing means are preferably as described between electrode structures when configured as an electrode module in the first aspect.

Alternatively, the present invention may provide a modular electrolyser comprising a plurality of connected electrode modules. In this case the electrode modules may be connected to each other by providing suitable electrical connections between adjacent modules.

For example, the recessed dish of the anode pan and the recessed dish of the cathode pan in adjacent modules are electrically joined, preferably at the apices of the projections.

Electrical conductivity may be achieved by the use of interconnectors or by close contact between the electrode structures. Electrical conductivity may be enhanced by the provision of conductivity-enhancing materials or conductivity-enhancing devices on the outer surface of the pans. As examples of conductivity-enhancing materials may be mentioned inter alia conductive carbon foams, conductive greases and coatings of a high-conductivity metal, e.g. silver or gold.

When connecting adjacent electrode modules together connections via welding, explosion bonding or a screw connection are not preferred. Instead connections are preferred which are formed by close physical contact between the adjacent electrode structures.

Electroconductivity-enhancing devices which can enhance the contact include electroconductive bimetallic contact strips, discs or plates, electroconductive metal devices, such as washers, or electroconductive metal devices adapted to (a) abrade or pierce the surface of the pans by cutting or biting through any electrically-insulating coating thereon, e.g. an oxide layer, and (b) at least inhibit formation of an insulating layer between the device and the surface of the pan (which may be referred to as an "abrasion device").

Such devices are described further in U.S. Pat. No. 6,761,808.

The number of modules or bipolar units may be chosen by the skilled man in the light of inter alia the required production volume, available power and voltage and certain constraints known to the skilled man. Typically, however, a modular or filter press electrolyser according to the second aspect of the present invention comprises 5-300 modules.

In a third aspect there is provided a process for the electrolysis of an alkali metal halide which comprises subjecting an alkali metal halide to electrolysis in a modular or filter press electrolyser according to the second aspect.

The modular or filter press electrolyser according to the third aspect of the present invention may be operated according to known methods. For example, it is typically operated at pressures between 50 and 600 kPa (0.5 and 6 bar) absolute pressure, preferably between 50 and 180 kPa (500 and 1800 mbar).

Liquid to be electrolysed is fed to the inlet-tubes in each electrode structure. For example, where the electrolyser is to be used for brine electrolysis inlet-tubes allow caustic to be charged to the cathode structure and brine to be charged to the anode structure. Products, namely chlorine and depleted brine solution from the anode structure and hydrogen and caustic from the cathode structure, are recovered from the respective headers.

The electrolysis may be operated at high current density, i.e. >6 $kA/m^2$.

In a yet further aspect the present invention provides an electrode structure comprising:

i) a pan with a dished recess and a flange which can interact with a flange on a second electrode structure to hold a separator in between the two and the dished recess further having a plurality of inwardly or outwardly projecting projections which can mate with corresponding projections on a third electrode structure in an electrode unit or in a modular electrolyser, ii) an inlet for liquid to be electrolysed and iii) an outlet header for evolved gas and spent liquid, wherein the outlet header is a tapered external outlet header which increases in cross-section area in the direction of gas/liquid flow towards the exit ports.

Preferably the external outlet header in this aspect comprises one or more internal cross members located along part of or all of the horizontal length of and attached internally to the sides of the header.

In this aspect the depth of the external outlet header may exceed the depth of the claimed electrode structure. In particular, when connected to said second and/or third electrode structure in an electrode module, electrode unit or modular electrolyser, the external outlet header of the claimed electrode structure can occupy space which is vertically above the second and/or third electrode structures.

Other features of the electrode structure may be generally as described in the first aspect. For example, the preferred electrode structure comprises a dished recess is provided with a plurality of inwardly projecting projections.

In a most preferred embodiment of this aspect the flange is around the periphery of the dished recess and being for supporting a gasket capable of sealing the separator between the electrode surface of the claimed electrode structure and the electrode surface of the second electrode structure such that the electrode surfaces are substantially parallel to and face each other, but are spaced apart from each other by the separator and are hermetically sealed to the separator. Further, the electrode structure comprises an electrode spaced from the pan but connected to the pan by electrically conductive pathways between the pan and the electrode with the proviso that where the claimed electrode structure is provided with a plurality of inwardly projecting projections the electrode may be directly electrically connected to the pan.

The electrode structure is preferably an anode structure. In particular, as already described the separator is most prone to damage caused by the formation of a gas space adjacent the separator on the anode side in the upper region of an electrolysis compartment, and also because the separation of formed chlorine from spent brine is the most problematic. The external outlet header located above the electrolysis compartment allows to minimise these problems because its location moves the gas disengagement area away from the separator and also provides increased flexibility to design its shape and size to improve the separation.

In a yet further aspect the present invention provides an electrode structure comprising:

i) a pan with a dished recess and a flange which can interact with a flange on a second electrode structure to hold a separator in between the two and the dished recess further having a plurality of inwardly or outwardly projecting projections which can mate with corresponding projections on a third electrode structure in an electrode unit or in a modular electrolyser, and ii) an inlet for liquid to be electrolysed and iii) an outlet header for evolved gas and spent liquid, wherein the outlet header of the claimed electrode structure is an internal outlet header and the outlet headers of the second and third electrode structures are external outlet headers.

Preferably the internal outlet header in this aspect comprises one or more internal cross members located along part of or all of the horizontal length of and attached internally to the sides of the header.

In this aspect the depth of the external outlet headers of the second and third electrode structures may exceed the depth of said electrode structures such that when the claimed electrode structure is connected to said second and/or third electrode structures in an electrode module, electrode unit or modular electrolyser, the external outlet header of the second or third electrode structures can occupy space which is vertically above the claimed electrode structure.

Again, other features of the electrode structure may be generally as described in the first aspect. For example, the preferred electrode structure comprises a dished recess is provided with a plurality of outwardly projecting projections.

In a most preferred embodiment of this aspect the flange is around the periphery of the dished recess and being for supporting a gasket capable of sealing the separator between the electrode surface of the claimed electrode structure and the electrode surface of the second electrode structure such that the electrode surfaces are substantially parallel to and face each other, but are spaced apart from each other by the separator and are hermetically sealed to the separator. Further, the electrode structure comprises an electrode spaced from the pan but connected to the pan by electrically conductive pathways between the pan and the electrode with the proviso that where the claimed electrode structure is an anode structure the electrode may be directly electrically connected to the pan.

The electrode structure is this aspect is preferably a cathode structure.

Finally, the present invention also provides methods of refurbishing electrode assemblies or modular or filter press electrolysers according to the above aspects.

For example, a method of refurbishing an electrode assembly may comprise:

a) providing an electrode structure, b) refurbishing said electrode structure, which refurbishment comprises:

i) detaching the electrode and attached current carriers from the pan or from posts to which the current carriers are connected, and ii) subsequently reattaching to the pan the same electrode after refurbishment thereof or a replacement electrode by attachment of the current carriers associated with the refurbished or replacement electrode to the pan or said posts, and c) reassembling the electrode structure.

When an anode or cathode plate of an electrode structure is in need of refurbishment it may be removed from the structure by removing any cushions to expose the central sections of the current carriers and thereby allow their detachment from the posts or, where no posts are present, from the electrode pan. Once the current carriers have been detached, the anode or cathode can then be removed for refurbishment. Refurbishment of an electrode may involve repair of sections of the electrode and/or recoating as required. Alternatively the electrode may be replaced with an entirely new electrode. The new or refurbished electrode is then physically and electrically reattached, for example by spot welding, threaded fasteners or push-fit connectors.

Refurbishment of electrode assemblies used in the chloralkali process is generally required every few years.

In an alternative embodiment, the method of refurbishing an electrode assembly may comprise:

a) providing an electrode structure, and b) refurbishing the electrode of said electrode structure whilst the electrode is still attached to the pan.

The refurbishment may comprise:

i) Removal of electrode coating from electrode contained in the pan in-situ, ii) Decontaminating, cleaning and drying the electrode structure, iii) Repairing any structural damage, e.g. by removal of damaged mesh or electrode blades and rewelding in uncoated replacements, iv) Recoating the repaired electrodes in-situ in the pan.

What is claimed is:

1. An electrode assembly comprising an anode structure and a cathode structure, each of said anode structure and cathode structure comprising i) a flange which can interact with a flange on another electrode structure to hold a separator in between the two, ii) an electrolysis compartment which contains an electrode, and which in use contains a liquid to be electrolysed, iii) an inlet for the liquid to be electrolysed and iv) an outlet header for evolved gas and spent liquid, wherein the outlet header on one of the anode structure and the cathode structure is an external outlet header wherein the external outlet header is an outlet volume by which gases evolved during electrolysis exit the electrode structure and which is provided on the electrode structure outside of the electrolysis compartment, and the outlet header on the other one of the anode structure and the cathode structure is an internal outlet header wherein the internal outlet header is an outlet volume by which gases evolved during electrolysis exit the electrode structure and which is provided on the electrode structure inside of the electrolysis compartment, and further where one or both of the outlet headers comprise one or more internal cross members located along part of or all of the length of and attached internally to the sides of the header.

2. An electrode assembly as claimed in claim 1 wherein each outlet header is an outlet volume which is provided on the individual anode or cathode structure and by which evolved gas exits the anode or cathode structure to an electrolyser collection header which is a volume which collects the gases evolved during electrolysis from the exits of multiple outlet headers and passes them to further processing.

3. An electrode assembly as claimed in claim 2 wherein each outlet header is an extended volume aligned parallel with the long horizontal axis of the electrode structure.

4. An electrode assembly as claimed in claim 1 where $V_E/(A_E \times L_E)$ is less than 1, where $V_E$ is the internal volume of the external outlet header in $cm^3$, $A_E$ is the internal cross sectional area at the exit end of the header $L_E$ is the internal length, more preferably where the external outlet header is tapered, and in particular increases in cross-section area in the direction of gas/liquid flow towards its exit port or ports.

5. An electrode assembly as claimed in claim 1 where the cross members are strips running internally along the length of the outlet header(s), attached to the sides of the header(s), and preferably wherein the cross members are provided with holes through the strips communicating from top to bottom.

6. An electrode assembly as claimed in claim 1 where the external outlet header of the electrode structure which has said external outlet header occupies space which is vertically above the adjacent electrode structure in an electrode module, electrode unit, modular electrolyser or filter press electrolyser.

7. An electrode assembly according to claim 1 wherein the outlet header on the anode structure is an external outlet header and the outlet header on the cathode structure is an internal outlet header.

8. An electrode assembly according to claim 1 wherein in each of said anode structure and cathode structure:

the electrolysis compartment comprises a pan with a dished recess, the flange being around the periphery thereof for supporting a gasket capable of sealing the separator between the anode surface of an anode structure and the cathode surface of a cathode structure such that the anode surface is substantially parallel to and faces but is spaced apart from the cathode surface by the separator and is hermetically sealed to the separator, and an electrode spaced from the pan but connected to the pan by electrically conductive pathways between the pan and the electrode with the proviso that where the electrode structure is an anode structure the electrode may be directly electrically connected to the pan, and preferably wherein the dished recess of one of the anode structure and cathode structure is provided with a plurality of outwardly projecting projections and the other of the anode structure and cathode structure is provided with a plurality of inwardly projecting projections the projections being such that the outwardly projecting projections can mate with the inwardly projecting projections in an adjacent electrode structure or electrode module in a modular electrolyser and wherein the electrically conducting pathways comprise one or more conductive posts which are provided with shoulders on which baffles may be mounted to improve circulation of fluids and gas in the electrode structure.

9. A modular or filter press electrolyser comprising a plurality of electrode assemblies as claimed in claim 1, and preferably which comprises 5-300 electrode assemblies.

10. A process for the electrolysis of an alkali metal halide which comprises subjecting an alkali metal halide to electrolysis in a modular or filter press electrolyser comprising a plurality of electrode assemblies, and preferably which comprises 5-300 electrode assemblies, said electrode assemblies each comprising an anode structure and a cathode structure, each of said anode structure and cathode structure comprising i) a flange which can interact with a flange on another electrode structure to hold a separator in between the two, ii) an electrolysis compartment which contains an electrode, and which in use contains a liquid to be electrolysed, iii) an inlet for the liquid to be electrolysed and iv) an outlet header for evolved gas and spent liquid, wherein the outlet header on one of the anode structure and the cathode structure is an external outlet header wherein the external outlet header is an outlet volume by which gases evolved during electrolysis exit the electrode structure and which is provided on the electrode structure outside of the electrolysis compartment, and the outlet header on the other one of the anode structure and the cathode structure is an internal outlet header wherein the internal outlet header is an outlet volume by which gases evolved during electrolysis exit the electrode structure and which is provided on the electrode structure inside of the electrolysis compartment.

11. An electrode structure comprising:

i) a pan with a dished recess and a flange which can interact with a flange on a second electrode structure to hold a separator in between the two and the dished recess further having a plurality of inwardly or outwardly projecting projections which can mate with corresponding projections on a third electrode structure in an electrode unit or in a modular electrolyser, and ii) an inlet for liquid to be electrolysed and iii) an outlet header for evolved gas and spent liquid, wherein the outlet header of the claimed electrode structure is an internal outlet header wherein the internal outlet header is an outlet volume by which gases evolved during electrolysis exit the electrode structure and which is provided on the electrode structure inside of the electrolysis compartment and the outlet headers of the second and third electrode structures are external outlet headers wherein the external outlet header is an outlet volume by which gases evolved during electrolysis exit the electrode structure and which is provided on the electrode structure outside of the electrolysis compartment, and further wherein each outlet header is an outlet volume which is provided on the individual electrode structure and by which evolved gas exits the electrode structure to an electrolyser collection header which is a volume which collects the gases evolved during electrolysis from the exits of multiple outlet headers and passes them to further processing.

12. An electrode structure as claimed in claim 11 wherein each outlet header is an extended volume aligned parallel with the long horizontal axis of the electrode structure.

13. An electrode structure according to claim 11 wherein the internal outlet header comprises one or more internal cross members located along part of or all of the horizontal length of and attached internally to the sides of the header.

14. An electrode structure according to claim 11 which is a cathode structure.

15. A method of refurbishing an electrode assembly which method comprises:

a) providing an electrode structure as defined in claim 8, b) refurbishing said electrode structure, which refurbishment comprises:

i) detaching the electrode and attached current carriers from the pan or from posts to which the current carriers are connected, and ii) subsequently reattaching to the pan the same electrode after refurbishment thereof or a replacement electrode by attachment of the current carriers associated with the refurbished or replacement electrode to the pan or said posts, and c) reassembling the electrode structure.

16. A method of refurbishing an electrode assembly which method comprises:

a) providing an electrode structure as defined in claim 8, b) refurbishing the electrode of said electrode structure whilst the electrode is still attached to the pan.

17. A method for refurbishing a modular or filter press electrolyser which comprises refurbishing one or more electrode structures according to the methods of claim 15.

* * * * *